United States Patent [19]

Shapiro et al.

[11] Patent Number: 4,586,967

[45] Date of Patent: May 6, 1986

[54] COPPER-TIN ALLOYS HAVING IMPROVED WEAR PROPERTIES

[75] Inventors: Eugene Shapiro, Hamden; Frank N. Mandigo, Northford, both of Conn.

[73] Assignee: Olin Corporation, New Haven, Conn.

[21] Appl. No.: 673,977

[22] Filed: Nov. 23, 1984

Related U.S. Application Data

[62] Division of Ser. No. 595,763, Apr. 2, 1984, Pat. No. 4,511,410.

[51] Int. Cl.[4] ..... C22C 9/02

[52] U.S. Cl. ..... 148/31.5; 148/160; 148/412; 148/433; 148/6.31; 420/470; 420/472

[58] Field of Search ..... 148/31.5, 160, 412, 148/433, 6.31; 420/470, 472

[56] References Cited

U.S. PATENT DOCUMENTS

| | | | |
|---|---|---|---|
| 115,220 | 5/1871 | Levi et al. | 148/13.2 |
| 2,237,243 | 4/1941 | Wilkins | 148/12.7 C |
| 2,636,101 | 4/1953 | De Pue | 148/13.2 |
| 3,505,104 | 4/1970 | Ingerson | 148/13.2 |
| 3,801,380 | 4/1974 | Ebner | 148/13.2 |
| 3,824,132 | 7/1974 | Wolfe et al. | 148/13.2 |
| 3,841,921 | 10/1974 | Shapiro et al. | 148/11.5 C |
| 4,443,274 | 4/1984 | Brock et al. | 148/13.2 |
| 4,478,651 | 10/1984 | Brock et al. | 148/31.5 |

FOREIGN PATENT DOCUMENTS

| | | | |
|---|---|---|---|
| 1051517 | 2/1959 | Fed. Rep. of Germany | 148/160 |
| 148112 | 11/1979 | Japan | 148/13.2 |

OTHER PUBLICATIONS

Metals Abstracts, "On the Heat Diffusion Treatment of a Cu-Sn Coated with Sn Plating", Abstr. No. 56-0512, May 1982.

Copper Development Association, Inc. Standards Handbook, "Wrought Copper and Copper Alloy Mill Products, Part 2-Alloy Data", 1973, pp. 141 and 142.

*Primary Examiner*—Veronica O'Keefe

*Attorney, Agent, or Firm*—Barry L. Kelmachter; Howard M. Cohn; Paul Weinstein

[57] ABSTRACT

A copper-tin alloy having improved wear performance and a process for forming the alloy is described herein. The alloy consists essentially of about 2% to about 11%, preferably about 3.5% to about 9% tin, about 0.03% to about 0.75%, preferably about 0.08% to about 0.5% phosphorous and the balance essentially copper. The processing for improving the wear performance includes a final heat treatment at a temperature in the range of about 400° C. to about 650° C., preferably about 500° C. to about 600° C. in an atmosphere having a dew point in the range of about −75° C. to about +95° C., preferably −57° C. to +21° C. and an oxygen level in the range of about 0.001 ppm to about 225 ppm.

5 Claims, No Drawings

COPPER-TIN ALLOYS HAVING IMPROVED WEAR PROPERTIES

This application is a division of application Ser. No. 595,763, filed Apr. 2, 1984, now, U.S. Pat. No. 4,511,410.

The present invention relates to copper-tin alloys having improved wear performance and a process for producing such alloys.

Copper-tin alloys or tin bronzes as they are known in the art have been used in a wide variety of applications because of their many desirable properties. They have been used in such applications as ornamental objects, ordinance and electrodes. U.S. Pat. Nos. 115,220 to Levi et al and 2,636,101 to DePue illustrate several copper-tin alloys and their uses. Today, copper-tin alloys such as copper alloy C51000 are used extensively in the electronics industry for electrical connectors, springs and other electrical components. U.S. Pat. Nos. 3,841,921 to E. Shapiro et al and 3,923,558 to S. Shapiro et al illustrate several of the copper-tin alloys used in the electronics industry.

In order to be competitive in the electronics industry, it is necessary to have a relatively high level of productivity while being cost effective. The current trend for increasing productivity is to fabricate components from strip material in presses that run faster, have more complex tooling and have more fabrication stations per press. This trend is only possible if significant numbers of parts can be fabricated between resharpening or replacement of tools. This makes tool wear a factor in the cost equation for selecting materials to be fabricated. Lower cost material that causes excessive rates of wear is not really cost effective. Conversely, materials that cause little, if any, tool wear during past fabrication might demand a premium price and still be cost effective.

The problem of improving the wear characteristics of bronzes has been of concern for some period of time. U.S. Pat. No. 3,824,132 to Wolfe et al illustrates a technique for treating copper-tin bronzes cast to have a substantial delta phase constituent in an alpha phase matrix. In this technique, the bronze is heated to a temperature between approximately 968° F. and 1470° F., held at the elevated temperature for a relatively short time period such as 15 seconds and then cooled. This heat treatment is intended to diffuse or start diffusing the delta phase crystals so that the sharp corners and edges of the delta phase crystals are diffused or rounded off. By diffusing or rounding off these sharp corners and edges, the stress risers in the alpha phase matrix are reduced or eliminated. Since the object of Wolfe et al's heat treatment is to diffuse or round off the sharp corners and/or edges of the delta phase crystals, this heat treatment may not be particularly suitable for solving the wear problems of single non-delta phase wrought alloys such as copper alloy C51000.

It is known that providing copper-tin alloys with certain types of surfaces can be beneficial. For example, forming a substantially continuous layer of tin-phosphorous oxide on a surface of a copper-tin alloy can improve its tarnish resistance. U.S. patent application Ser. Nos. 446,758, filed Dec. 3, 1982, now U.S. Pat. No. 4,443,274, and 538,252, filed Oct. 3, 1983, now U.S. Pat. No. 4,478,651 both to Brock et al illustrate a technique for forming a tin-phosphorous-oxide layer on a surface of a copper-tin alloy. It is also known that certain surfaces on copper-tin alloys are undesirable. For example, cassiterite, a crystalline tin oxide, on the surface of alloys such as copper alloy C51000 can cause rapid tool wear. Because of this, a great deal of effort has been spent in developing commercial plant processing that produces copper-tin alloy strip material with fully cleaned surfaces. It was believed that such a material minimizes the rate of tool wear. Recently, it has been discovered that clean copper-tin alloy strip material without any oxide does not perform as well as strip material with tin sweat or an amorphous film remaining on its surfaces. It is believed that a tin sweat or amorphous film layer on such material acts as a solid film lubricant which reduces tool wear.

It is an object of the present invention to provide a copper-tin alloy have improved wear performance.

It is a further object of the present invention to provide a process for providing a copper-tin alloy as above.

These and further objects and advantages will become apparent from the following specification.

In accordance with the present invention, a method for improving the wear performance of copper-tin alloys is described. The method is particularly useful for improving the wear performance of copper-tin alloys consisting essentially of about 2% to about 11% tin, about 0.03% to about 0.75% phosphorous and the balance essentially copper. It has been discovered that by controlling the phosphorous content in such alloys and the conditions under which the alloys are annealed, a thin layer of a type of solid film lubricant can be produced on one or more surfaces of the alloy material. It is believed that this lubricant film improves the wear performance of the alloys.

The method for forming the aforesaid lubricant film layer comprises annealing the alloy material at a temperature in the range of about 400° C. to about 650° C. in an atmosphere having a dew point in the range of about −75° C. to about +95° C. and an oxygen level less than about 300 ppm. The annealing atmosphere may be any suitable annealing gas such as Exogas, nitrogen, 96%$N_2$/4%$H_2$, or 94%$N_2$/4%$H_2$/2% CO. The above annealing temperature range is defined by the need on one hand to anneal or soften the material and the need on the other hand to substantially prevent orange peel due to large grain size and the loss of mechanical properties. It has been found to be desirable for the alloy to contain sufficient phosphorous and the atmosphere to contain at least some oxygen in order to promote tin sweat formation. The upper limits of the above dew point and oxygen level ranges are defined by the need to prevent cassiterite and/or copper oxides from forming on the alloy surfaces.

In a preferred embodiment, the copper alloys consist essentially of about 3.5% to about 9% tin, about 0.08% to about 0.5% phosphorous and the balance essentially copper. The desired lubricating type film is formed by annealing said alloy at a temperature in the range of about 500° C. to about 600° C. in an atmosphere having a dew point in the range of about −57° C. to about +21° C. and an oxygen level in the range of about 0.001 ppm to about 225 ppm. Under these conditions, the lubricating film should be either a coating of tin sweat nodules or an amorphous film of a tin-containing compound. The amorphous film preferably comprises a thin, substantially continuous layer of a tin-containing compound. The tin sweat type lubricating film comprises a plurality of discrete beads of tin-containing material that cover at least about 5% of the surface.

Preferably the tin sweat covers at least about 10% of the surface and most preferably it covers substantially the entire alloy surface.

As previously discussed, the wear performance of certain copper-tin alloys may be improved by forming a relatively thin, solid-type lubricating film on at least one surface of a copper-tin alloy material to be processed. The most desirable film comprises either a layer of tin sweat nodules or an amorphous film layer. It is believed that the tin sweat nodules improve the wear performance by providing a non-metallic, dry film lubricant preventing metal to metal contact. The amorphous film layer is believed to function in a similar manner.

The least desirable surfaces on copper-tin alloy materials from a wear standpoint appear to be fully cleaned strip and cassiterite. If the material is fully cleaned, tool wear is believed to occur by an adhesive wear mechanism. Cassiterite (crystalline tin oxide) is an undesirable surface constituent because it is a hard oxide that causes rapid tool wear by an abrasive wear mechanism.

It has been found that the most desirable copper-tin alloy surfaces can be formed by controlling alloy composition, particularly the phosphorous content, and annealing conditions, particularly temperature, annealing gas dew point and annealing gas oxygen content. Copper-tin alloys in accordance with the present invention may have a composition consisting essentially of about 2% to about 11% tin, about 0.03% to about 0.75% phosphorous and the balance essentially copper. In a preferred embodiment, the copper-tin alloys consist essentially of about 3.5% to about 9% tin, about 0.08% to about 0.5% phosphorous and the balance essentially copper. Conventional brass mill impurities may be tolerated in the alloys of the present invention but should be kept to a minimum. In accordance with the present invention, alloys preferably contain at a minimum sufficient phosphorous to generate tin sweat. The aforementioned phosphorous ranges should be sufficient to promote such tin sweat formation.

The alloys of the present invention may be cast in any desired manner. For example, they may be cast using continuous casting, strip casting, direct chill casting or Durville casting. Any suitable pouring temperature may be used during casting.

After casting, the alloys of the present invention may be processed in any desired manner. Generally, the alloys will be processed by breaking down the cast ingot into a strip material. The processing may comprise hot working the cast ingot into a sheet or plate followed by cold working to final gage. The hot working step preferably comprises hot rolling of the ingot. The hot rolling may be performed at any suitable initial temperature using any suitable conventional apparatus known in the art. After hot working, the material may be cooled in any suitable manner using any suitable cooling rate. If necessary, the material may be coil milled after hot working. In lieu of hot working, the alloys may be strip cast and cold worked to final gage.

The cold working following the hot working or strip casting preferably comprises cold rolling of the material. During such cold rolling, the material may be subjected to one or more passes through a rolling mill until the desired final gage is reached. The rolling mill may comprise any conventional rolling apparatus known in the art.

If needed, one or more interanneals may be performed between the cold working steps or cold rolling passes. The interanneals may be performed using any conventional annealing technique known in the art. After each interanneal, the material is preferably cleaned to remove undesirable oxides, particularly cassiterite. Any suitable cleaning technique known in the art including mechanical and/or chemical techniques may be used to remove the unwanted oxides.

After having been processed to a desired final gage, the material is then subjected to a heat treatment for forming either a tin sweat layer or an amorphous film layer on one or more of its surfaces. As previously discussed, it has been found that the production of one these surface layers improves tool wear performance of the alloys of the present invention by acting as a lubricant film for preventing metal to metal contact. Where further treatment such as a stress relief anneal at final gage or additional cold working is needed, the lubricating film forming heat treatment may be performed either before or after the further treatment.

In accordance with the present invention, the film forming heat treatment comprises annealing the material at a temperature in the range of about 400° C. to about 650° C., preferably from about 500° C. to about 600° C., in an annealing or reducing gas atmosphere having a dew point in the range of about −75° C. to about +95° C., preferably from about −57° C. to about +21° C., and an oxygen level less than about 300 ppm, preferably from about 0.001 ppm to about 225 ppm. Any suitable annealing time may be used to perform the final heat treatment; however, it is preferred to avoid rapid annealing times because they promote cassiterite formation. Suitable annealing times are in the range of about 30 minutes to about 24 hours, preferably from about 2 hours to 18 hours. This heat treatment may be performed in any suitable manner using any suitable conventional apparatus known in the art. The annealing or reducing gas atmosphere may comprise any suitable annealing atmosphere known in the art such as $N_2$, 96%$N_2$/4%$H_2$, 94%$N_2$/4%$H_2$/2%CO, or Exogas. Exogas is the products from the combustion of natural gas.

The tool wear performance of the material and the ability to produce one of the desired lubricant film layers have been found to be strongly dependent upon the phosphorous content of the material and the aforementioned temperature, dew point and oxygen level annealing parameters. For example, it has been determined that increasing phosphorous levels tend to decrease tool wear while decreasing dew points at relatively low annealing temperatures or higher oxygen levels tend to increase tool wear. While individual ones of these parameters affect tool wear performance, it appears that careful control of all these parameters is required to obtain the desired tool wear performance and to produce one of the desired lubricant films. This is because the aforementioned parameters are very much interrelated. For example, it has been discovered that a treatment with decreasing dew points at a 500° C. annealing temperature in a nitrogen atmosphere containing 50 ppm oxygen can decrease tool wear. It is also known that the effect of oxygen on tool wear performance increases as phosphorous content decreases.

The present invention and the improvements resulting therefrom will be more readily apparent from a consideration of the following illustrative examples.

EXAMPLE I

To determine the effect on wear performance of various strip surfaces, copper-tin alloy samples were prepared, annealed to obtain a desired surface and evaluated using a pin-on-disk test. The copper-tin alloys that were evaluated had the following nominal compositions: (1) 4% Sn, balance essentially Cu; (2) 5.18% Sn, 0.08% P and the balance essentially Cu; and (3) 5% Sn, 0.43% P and the balance essentially Cu.

The alloys were processed from 10 pound ingots that were cast and poured at a temperature ranging from 1100° C. to 1150° C. The binary copper-tin alloy was homogenized at 800° C. for 2 hours and then hot rolled without reheats to 0.50" gage. The hot rolled plate was coil milled to remove surface defects and cold rolled to 0.030" gage. 4½"×4½" samples were cut from the cold rolled strip and annealed at 400° C., 500° C. and 600° C. for 4 hours in either a wet dew point (+21° C.) or a dry dew point (<−18° C.) 96%$N_2$/4%$H_2$ atmosphere. The ternary Cu-Sn-P alloys were cast and a 0.5"×4"×4" slice was cut from each ingot, coil milled and then cold rolled to 0.030" gage. 4½"×4½" samples were cut and annealed at 600° C. for 4 hours in either a wet dew point (+21° C.) or a dry dew point (−57° C.) 96% $N_2$/4%$H_2$ atmosphere.

The surfaces produced on the samples included: (1) cassiterite; (2) tin sweat; (3) amorphous film; (4) fully cleaned; and (5) tin sweat nodules and cleaned in a 10% $H_2SO_4$ acid solution (ambient). To produce the fully cleaned surfaces, several samples were cleaned in a solution of 50% nitric acid, 25% orthophosphoric acid and 25% acetic acid for 45 seconds.

After processing had been completed, each sample was subjected to a pin-on-disk test to measure the wear scar and the wear volume. The pin-on-disk apparatus rotates a square sample at speeds ranging from 50 to 1000 RPM. The wear pin is a 3/16" diameter ball of alloy E52100 gripped in a stylus at the end of a balance beam. The balance beam holding the wear pin can be fixed or swept back and forth from a small to a large diameter position during the test. The applied load can be varied by moving a weight along the balance beam that holds the wear pin. This test allows collection of wear debris because the pin motion relative to the test sample is in a constant direction.

The fixed variables for the test were a test speed of 200 RPM, a time of 120 seconds which produces a sliding distance of about 2500" and a single repetitive track stylus position. All samples were vapor degreased and tested without lubrication. The applied load was varied over the range from 100 grams to 600 grams. The wear scars on the pin and the disk were examined at 100× for debris, metal adhesion and extent of metal removal. The pin wear scar is measured at 100× and a wear volume is calculated assuming the wear scar is flat and circular. After determining the wear volume, the wear constant K for a particular type of surface can be determined from the following equation:

$$W_v KPX/H \quad (1)$$

where $W_v$=wear volume

K=wear constant

P=applied load

X=sliding distance

H=pin hardness

Table I shows the wear performance of the samples as a function of applied load and annealing conditions.

TABLE I

| Alloy Comp. | Anneal T (°C.) | Anneal t (hrs) | Atmosphere (dew point) | Surface | Applied Load (gms) | Scar Size (mm 100X) | Wear Volume ($mm^3 \times 10^{-5}$) |
|---|---|---|---|---|---|---|---|
| Cu—4Sn | 500 | 4 | Exogas (+21° C.) | Cassiterite | 200 | 43 | 69 |
| Cu—4Sn | 500 | 4 | Exogas (+21° C.) | Cassiterite | 400 | 46 | 92 |
| Cu—4Sn | 500 | 4 | Exogas (+21° C.) | Cassiterite | 600 | 56 | 210 |
| Cu—4Sn | 600 | 4 | Exogas (+21° C.) | Cassiterite | 100 | 36 | 37 |
| Cu—4Sn | 600 | 4 | Exogas (+21° C.) | Cassiterite | 200 | 50 | 135 |
| Cu—5Sn—.43P | 600 | 4 | 96$N_2$/4$H_2$ (+21° C.) | Tin Sweat | 200 | — | <.1 |
| Cu—5Sn—.43P | 600 | 4 | 96$N_2$/4$H_2$ (+21° C.) | Tin Sweat | 600 | — | <.1 |
| Cu—5Sn—.43P | 600 | 4 | 96$N_2$/4$H_2$ (−57° C.) | Tin Sweat | 200 | — | <.1 |
| Cu—5Sn—.43P | 600 | 4 | 96$N_2$/4$H_2$ (−57° C.) | Tin Sweat | 400 | — | <.1 |
| Cu—5Sn—.43P | 600 | 4 | 96$N_2$/4$H_2$ (−57° C.) | Tin Sweat | 600 | — | <.1 |
| Cu—5.18Sn—.08P | 600 | 4 | 96$N_2$/4$H_2$ (+21° C.) | Tin Sweat | 200 | — | <.1 |
| Cu—4Sn | 400 | 4 | 96$N_2$/4$H_2$ (−29° C.) | Amorphous | 200 | 30 | 17 |
| Cu—4Sn | 400 | 4 | 96$N_2$/4$H_2$ (−29° C.) | Amorphous | 400 | 49 | 120 |
| Cu—4Sn | 400 | 4 | 96$N_2$/4$H_2$ (−29° C.) | Amorphous | 600 | 64 | 350 |
| Cu—4Sn | 500 | 4 | 96$N_2$/4$H_2$ (−18° C.) | Amorphous | 200 | 19 | 2.7 |
| Cu—4Sn | 500 | 4 | 96$N_2$/4$H_2$ (−18° C.) | Amorphous | 400 | 46 | 93.0 |
| Cu—4Sn | 500 | 4 | 96$N_2$/4$H_2$ (−18° C.) | Amorphous | 600 | 54 | 180.0 |
| Cu—4Sn | 600 | 4 | 96$N_2$/4$H_2$ (−57° C.) | Amorphous | 200 | 20 | 3.3 |
| Cu—4Sn | 600 | 4 | 96$N_2$/4$H_2$ (−57° C.) | Amorphous | 400 | 44 | 76.0 |
| Cu—4Sn | 600 | 4 | 96$N_2$/4$H_2$ (−57° C.) | Amorphous | 600 | 56 | 210.0 |
| Cu—4Sn | 400 | 4 | 96$N_2$/4$H_2$ (−) | Fully Cleaned | 100 | 31 | 19.0 |
| Cu—4Sn | 400 | 4 | 96$N_2$/4$H_2$ (−) | Fully Cleaned | 200 | 41 | 28.0 |
| Cu—4Sn | 400 | 4 | 96$N_2$/4$H_2$ (−) | Fully Cleaned | 400 | 51 | 145.0 |
| Cu—4Sn | 500 | 4 | 96$N_2$/4$H_2$ (−) | Fully Cleaned | 100 | 29 | 14.5 |
| Cu—4Sn | 500 | 4 | 96$N_2$/4$H_2$ (−) | Fully Cleaned | 200 | 38 | 42.0 |
| Cu—4Sn | 500 | 4 | 96$N_2$/4$H_2$ (−) | Fully Cleaned | 400 | 50 | 132.0 |
| Cu—4Sn | 600 | 4 | 96$N_2$/4$H_2$ (−) | Fully Cleaned | 100 | 29 | 14.5 |
| Cu—4Sn | 600 | 4 | 96$N_2$/4$H_2$ (−) | Fully Cleaned | 200 | 43 | 69.5 |
| Cu—4Sn | 600 | 4 | 96$N_2$/4$H_2$ (−) | Fully Cleaned | 400 | 48 | 48.0 |
| Cu—5Sn—.43P | 600 | 4 | 96$N_2$/4$H_2$ (−) | Fully Cleaned | 200 | 47 | 100.0 |
| Cu—5.18Sn—.08P | 600 | 4 | 96$N_2$/4$H_2$ (−) | Fully Cleaned | 200 | 42 | 63.0 |
| Cu—5Sn—.43P | 600 | 4 | 96$N_2$/4$H_2$ (+21° C.) | Tin Sweat & Clean | 200 | 27 | 11.0 |
| Cu—5Sn—.43P | 600 | 4 | 96$N_2$/4$H_2$ (+21° C.) | Tin Sweat & Clean | 400 | 43 | 69.0 |
| Cu—5Sn—.43P | 600 | 4 | 96$N_2$/4$H_2$ (+21° C.) | Tin Sweat & Clean | 600 | 46 | 92.0 |
| Cu—5Sn—.43P | 600 | 4 | 96$N_2$/4$H_2$ (−57° C.) | Tin Sweat & Clean | 200 | — | <.1 |
| Cu—5Sn—.43P | 600 | 4 | 96$N_2$/4$H_2$ (−57° C.) | Tin Sweat & Clean | 400 | — | <.1 |
| Cu—5Sn—.43P | 600 | 4 | 96$N_2$/4$H_2$ (−57° C.) | Tin Sweat & Clean | 600 | — | <.1 |

From the above data, it is apparent that wear performance is dependent upon the surface constituents produced during annealing. The relative ranking of the surfaces with respect to wear performance are:

best—annealed with >10% coverage of tin sweat nodules, no cleaning.

better=annealed in a dry 96%$N_2$/4%$H_2$ atmosphere with 10% coverage of tin sweat nodules and cleaned with 10%$H_2SO_4$.

good—annealed in a wet 96%$N_2$/4%$H_2$ atmosphere with >10% coverage of tin sweat nodules and cleaned in 10% $H_2SO_4$.

good—as annealed with amorphous films on the surface.

fair—fully cleaned strip.

bad—cassiterite (crystalline tin oxide).

The wear constants for various surfaces are described in Table II below.

TABLE II

| Surface | Wear Constant, K |
|---|---|
| Cassiterite | $4.5 \times 10^{-5}$ |
| Fully Cleaned | $1.2 \times 10^{-5}$ |
| Amorphous Film | $0.5 \times 10^{-5}$ |
| Tin Sweat | $\approx 0$ |

It is believed that Cu-Sn-P strip having a fully cleaned surface and the above wear constant would allow about 300,000 to 500,000 parts to be fabricated before resharpening of the tooling is required. Cu-Sn-P strip having an amorphous film surface and the above wear constant is believed to be capable of fabricating about 3 to 4 million parts before resharpening of the tooling is required.

EXAMPLE II

To illustrate the effects of the various annealing parameters on surface films produced and wear performance, several samples of Cu-Sn-P alloys were tested. The nominal composition of each sample is set forth in Table III below.

TABLE III

| Sample | Sn (%) | P (%) | Cu (%) |
|---|---|---|---|
| A | 4.2 | .045 | bal. |
| B | 4.7 | .130 | bal. |
| C | 5.04 | .042 | bal. |
| D | 5.04 | .120 | bal. |

Samples A and B came from commercial lots of Cu-Sn-P alloys while samples C and D were laboratory cast and processed. The laboratory samples were cast and poured at 1150° C. The cast material was homogenized at 750° C. for 4 hours and air cooled and then homogenized at 840° C. for 1 hour and air cooled again. Thereafter, they were soaked at 800° C. for 1 hour and then hot rolled to 0.40". During hot rolling, the material was reheated after every third pass. The material was then homogenized at 500° C. for 4 hours, coil milled and cold rolled to 0.1". The samples were annealed at 500° C. for 1 hour. After annealing, the samples were cleaned in a bright dip solution comprising 50% nitric acid, 25% orthophosphoric acid and 25% acetic acid and rubbed with steel wool. After cleaning, the samples were cold rolled to a final gage of about 0.016".

The samples of strip A were annealed at 500° C. for one hour at dew points of −20° C., 0° C. and 5° C. respectively with intentional oxygen additions of 50, 200 and 50 ppm respectively. A nitrogen atmosphere was used.

Samples of strip B were annealed at 500° C. and 600° C. for one hour. The 500° C. samples were annealed in a nitrogen atmosphere at dew points of −20° C., 0° C. and 5° C. with intentional oxygen additions of 50, 200 and 50 ppm respectively. The 600° C. sample was annealed in an Exogas atmosphere having a dew point of 20° C. and no intentional oxygen addition. Samples of laboratory cast strip C were annealed at 400° C., 500° C. and 600° C. for one hour in a nitrogen atmosphere. The samples were annealed at dew points of −20° C., 20° C. 0° C. and 20° C. respectively. The atmosphere had no intentional oxygen addition.

A sample of laboratory cast strip D was annealed at 500° C. for one hour in a nitrogen atmosphere having a dew point of 0° C. and no intentional oxygen addition.

All samples were vapor degreased prior to test. Sliding wear performance was determined using a pin-on-strip test apparatus. The pin-on-strip test apparatus comprised a stationary wear pin and a movable table which grips the strip sample. The table moved back and forth at a desired test speed. The table was also capable of being indexed to provide a new test surface at the end of each stroke. The test conditions were 300 grams applied load, 3000" sliding distance and an alloy E52100 pin Lard oil lubricant was applied to each strip sample. The pin wear scar was measured at the completion of the test and both strip and pin were examined for wear debris and general appearance. Wear volume was calculated assuming the wear scar is flat and circular.

The sliding wear test data and the annealing parameters are listed in Table IV below. It is believed that this data illustrates not only the effect of the individual parameters on surface film production but the interrelationship between the various parameters. For example, the data shows that annealing atmosphere dew point may either increase or decrease tool wear. As can be seen from the data on Sample C, a decreasing dew point increases tool wear at a 400° C. annealing temperature. By viewing the data on samples of alloy A annealed at 500° C. with an intentional oxygen addition of 50 ppm, it appears that a decreasing dew point decreases tool wear; however, as can be seen from the 500° C. annealed samples of alloy B, increasing phosphorous content appears to decrease tool wear at higher dew points.

By comparing the test results for samples A and B, it can be seen that the data indicates that higher oxygen levels increase tool wear. Finally, as can be seen from the data on Sample C, increasing annealing temperature slightly improves tool wear performance of the samples annealed in nitrogen at a dew point of +20° C.

TABLE IV

| Sample | Dew Pt (°C.) | Anneal T (°C.) | $O_2$ (ppm) | Wear Volume ($mm^3 \times 10^{-5}$) |
|---|---|---|---|---|
| A | −20 | 500 | 50 | 31 |
| A | 0 | 500 | 200 | 72 |
| A | 5 | 500 | 50 | 72 |
| B | −20 | 500 | 50 | 3.3 |
| B | 0 | 500 | 200 | 9.4 |
| B | 5 | 500 | 50 | 1.4 |
| B | 20 | 600 | — | 0.4 |
| C | −20 | 400 | — | 23 |
| C | 20 | 400 | — | 11 |
| C | 0 | 500 | — | 23 |
| C | 20 | 600 | — | 9.5 |
| D | 0 | 500 | — | 12.5 |

It is believed that these examples demonstrate the benefits e.g. improved wear performance characteristics which can be obtained using the present invention. The copper-tin-phosphorous alloys described hereinbefore processed in accordance with the present invention have been found to have particular utility as electronic and electrical components.

The patents and patent applications set forth in the specification are intended to be incorporated by reference herein.

As used herein, the percentage relating to each element in the alloys are weight percentages.

It is apparent that there has been provided in accordance with this invention copper-tin alloys having improved wear properties which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A copper-tin alloy having a lubricating type, discontinuous film on at least one surface to improve wear performance, said alloy consisting essentially of about 2% to about 11% tin, about 0.03% to about 0.75% phosphorous and the balance essentially copper; and said film being formed by subjecting said alloy to a heat treatment at a temperature in the range of about 400° C. to about 650° C. in an atmosphere having a dew point in the range of about −75° C. to about +95° C. and an oxygen level less than about 300 ppm.

2. The copper tin alloy of claim 1 wherein:

said film being formed by subjecting said alloy to a heat treatment at a temperature in the range of about 500° C. to about 600° C. in an atmosphere having a dew point in the range of about −57° C. to about +21° C. and an oxygen level in the range of about 0.001 ppm to about 225 ppm.

3. The copper-tin alloy of claim 1 wherein:

said alloy consists essentially of about 3.5% to about 9% tin, about 0.08% to about 0.5% phosphorous and the balance essentially copper.

4. The alloy of claim 1 wherein said film comprises:

a plurality of discrete tin sweat nodules on said at least one surface.

5. The alloy of claim 1 wherein said film comprises:

a tin-containing amorphous film on said at least one surface.

* * * * *